US006021590A

United States Patent [19]

Morimoto et al.

[11] Patent Number: 6,021,590

[45] **Date of Patent: *Feb. 8, 2000**

[54] ELASTIC SPIKES AND SPORTS SHOES WITH THE ELASTIC SPIKES

[75] Inventors: Mitsuhiko Morimoto; Tadatoshi Yamada, both of Chichibu, Japan

[73] Assignee: Bridgestone Sports Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/821,307

[22] Filed: Mar. 20, 1997

[30] Foreign Application Priority Data

| | | | |
|---|---|---|---|
| Mar. 21, 1996 | [JP] | Japan | 8-089930 |
| Jul. 11, 1996 | [JP] | Japan | 8-199550 |
| Sep. 19, 1996 | [JP] | Japan | 8-267683 |
| Sep. 19, 1996 | [JP] | Japan | 8-267684 |
| Oct. 4, 1996 | [JP] | Japan | 8-281633 |
| Feb. 27, 1997 | [JP] | Japan | 9-060034 |

[51] Int. Cl.[7] ..... A43C 13/04; A43C 15/14

[52] U.S. Cl. ..... 36/134; 36/127; 36/61; 36/67 A

[58] Field of Search ..... 36/61, 67 A, 67 D, 36/67 R, 127, 134

[56] References Cited

U.S. PATENT DOCUMENTS

| | | | |
|---|---|---|---|
| 3,739,499 | 6/1973 | Morin | 36/67 D |
| 4,327,503 | 5/1982 | Johnson | 36/67 A |
| 4,546,559 | 10/1985 | Dassler | 36/129 |
| 5,289,647 | 3/1994 | Mercer | 36/134 |
| 5,351,422 | 10/1994 | Fitzgerald | 36/134 |
| 5,634,283 | 6/1997 | Kastner | 36/61 |

FOREIGN PATENT DOCUMENTS

| | | | |
|---|---|---|---|
| 0223700 | 5/1987 | European Pat. Off. | 36/127 |
| 3046811 | 7/1982 | Germany | 36/134 |
| 2223394 | 4/1990 | United Kingdom | 36/134 |
| 91/07888 | 6/1991 | WIPO | 36/127 |

*Primary Examiner*—Paul T. Sewell
*Assistant Examiner*—Anthony Stashick
*Attorney, Agent, or Firm*—Sughrue, Mion, Zinn, Macpeak & Seas, PLLC

[57] ABSTRACT

A spike for a sole is provided with a pin and a receiving portion for receiving a rear end portion of the pin, an elastic member is provided between the rear end portion of the pin and the receiving portion, a sports shoe having elastic spikes is also provided with the sole, and the rubber spikes being arranged in combination with the elastic spikes each including the pin, the receiving portion and the elastic member.

11 Claims, 8 Drawing Sheets

ELASTIC SPIKES AND SPORTS SHOES WITH THE ELASTIC SPIKES

BACKGROUND OF THE INVENTION

The present invention relates to an elastic spike provided on soles of sports shoes such as golf shoes for preventing slippage. It also relates to sports shoes using such spikes.

A plurality of slippage preventing spikes are provided around a region of each sole where weight is mainly applied upon walking and any other activities. The conventional spikes, as a whole, including pins to be stuck into the ground and receiving portions for receiving the pins are made of hard substance such as metal or resin.

For example, when such conventional spikes are tacked in golf shoes which are sometimes used on a soft place such as a fairway or a green having grass and which are other times used on a hard place such as a paved hard way provided between the courses, if the golfer walks on a paved way, he or her is likely to be tired and also makes collision noises with the road surface. In this case, the uncomfortable noise frequencies collision would be transmitted to the feet.

In order to overcome the foregoing problem, such a structure has been proposed having a coil spring interposed between each pin and an associated receiving portion. When a pressure is applied to a tip end of the pin, the pin is slid into the receiving portion and when the pin is relieved from the pressure, the pin is returned back to the original position by the action of the spring. However, such a structure suffers from the problem that water enters between the pin and the receiving portion to rust the spring or otherwise mud or grass enters therebetween to obstruct the function of the spring.

SUMMARY OF THE INVENTION

An object of the present invention is to provide an elastic spike having a damping effect and a pair of sports shoes using the elastic spikes which may suppress any collision noise and which may eliminate the rust problem and degradation due to the clogging of mud or grass.

According to a first aspect of the invention, there is provided a spike for a sole, comprising a pin and a receiving portion for receiving a rear end portion of said pin, wherein an elastic member is provided between the rear end portion of said pin and said receiving portion.

According to a second aspect of the invention, there is provided a sports shoe having elastic spikes, and a sole wherein a rubber spike is arranged in combination with an elastic spike including a pin, a receiving portion for receiving a rear end portion of said pin, and an elastic member interposed between said pin and said receiving portion.

According to a third aspect of the invention, there is provided a sports shoe having elastic spikes wherein the elastic spikes having pins, receiving portions for receiving rear end portions of said pins and elastic members between the rear end portions of said pins and said receiving portions, characterized in that plural elastic members having different hardnesses in said elastic members are arranged on a sole.

With the elastic spikes according to the first aspect of the invention, when pressure is applied to tip ends of the pins during walking, a shearing deformation is applied to the elastic members behind the pins or on the side of and behind the pins, and a compression deformation is caused to the elastic members behind the pins. As a result, the pins are moved rearwardly. Accordingly, the collision noises of the pins and the collision shock against the feet may be suppressed. It is possible to eliminate any bad feeling caused by these factors.

Also, when the pressure to the pins is released, the pins are returned back to the original position. Since the elastic members fill the receiving portions, the degradation of function caused by entrainment of foreign matter such as water or mud into the receiving portion may be avoided. Also, the same effect can be obtained even in the case where column-like elastic members are independently arranged behind the pins.

Also, in sports shoes according to the second aspect of the invention, the elastic spikes exhibit an excellent function in the slippage preventing feature. The rubber spikes exhibit an excellent function in the fatigue preventing feature. The elastic spikes and the rubber spikes are arranged in combination to thereby promote the superior features of both spikes.

In particular, in the case of golf shoes, a height of pins of the elastic spikes is kept at least equal to or greater than that of the rubber spikes. As a result, mainly, the elastic spikes exhibit their effect on a soft ground such as fairway. Upon walking on the hard ground, the pins are retracted, so that the player may enjoy walking and having a cushioning effect caused by the rubber softness of the rubber spikes to thereby suppress the generation of uncomfortable noises. Also, the shoes are not slippery. The player is hardly tired. Since the elastic spikes are projected and retractable, collision noises against the ground are suppressed. The player may enjoy a comfortable walk.

In sports shoes according to the third aspect of the invention, elastic spikes different in hardness are arranged on the sole. The pressure is not uniformly applied to the sole during walking or playing. The heel and the tread are subjected to a higher pressure than to the toe. In particular, the outside of the heel tends to be subjected to a higher pressure than to the inside. Accordingly, for example, the elastic members having a relatively low hardness are arranged in regions where a higher pressure is applied, to thereby more effectively attain the objects of the present invention.

With respect to the shape of the pins, it is possible to use a conical shape whose tip is tapered, a bullet-shape, a truncated conical shape or a cylindrical shape, and in some cases to use an angular column shape. However, it is preferable to select the bullet shape and the truncated conical shape.

A diameter of the pins (diameter maximum with conical shape, bullet shape and truncated conical shape) is in the range of 1.5 to 8 mm, more preferably about 3 mm.

Also, a flange having a diameter larger by 1.5 mm than the above-specified values is formed at the rear end position of the pins. The form is preferably an inverted T-shape.

The material of the pins as well as that of the receiving portion to be described later may be selected from hard material such as various metals, ceramics and plastics. In particular, it is preferable to use metal material such as iron, aluminum, copper, brass and the like.

The receiving portions at the rear end portion of the pins are cylindrical members having hollow spaces in the interior. Normally, the receiving portions are the cylindrical members. The size (diameter) of the hollow space is such that the rear end portion of the pin to be received in the receiving portion, in particular, the flange of the pin having the larger diameter may smoothly move in the axial direction. Also, a depth of the hollow space (axial length) is such that the elastic member to be described later may be received in the hollow space. The receiving portion preferably takes a structure in which a bottom is formed in a bottom portion of the receiving portion; and a screw is formed around the periphery of the receiving portion, the elastic member and the pin rear portion are received, thereafter, the pin body is caused to pass through the skirt having, in the center, the hole through which the pin body is caused to pass, and thereafter the opening portion of the receiving portion is closed.

After the pin is set in the receiving portion, the elastic member is fastened and formed into one piece with the pin and the receiving portion so that the elastic member may fill the rear end portion of the pin and the hollow space as a whole within the receiving portion. Preferably, the elastic member is formed into a column shape, and normally in a column shape as a discrete member and is detachably received in the hollow space defined between the rear end flange of the installed pin and the bottom of the receiving portion. The shape of the elastic member may be a truncated cone, a sphere, an oblong sphere and the like in addition to the above-specified shapes. In the case where the elastic member is cylindrical and detachable, it is preferable that the diameter (a) is in the range of 2 to 8 mm, and more preferably about 3 mm. On the other hand, it is preferable that the height (c) is in the range of 3 to 8 mm, and more preferably about 4 mm.

It is possible to use, as material for the elastic member, foamed or solid rubber material such as SBR, BR, IR, NR, PUR (polyurethane rubber). The physical characteristics of the rubber preferably meets the condition of JIS A hardness of 40 to 90° (Shore A hardness 41.5 to 95.0°) and more preferably meets the condition of JIS A hardness of 80° (Shore A hardness 84.5°). It is preferable that the hysteresis loss is in the range of 10 to 50%, and more preferably 15 to 35%. (Measurement condition: A test sample of a diameter of 29.0 mm and a thickness (height) of 12.5 mm is prepared. A compressive deformation of 25% is applied plural times to the sample at room temperature of 23° C. at a rate of 10 mm/min. When the above-described deformation is applied fourth time, a curve of the relation between a pressure and a compressive deformation is recorded. The hysteresis (value) is obtained from the recording chart (generally based upon JIS system 6254).)

The rear end portion of the elastic member has a large diameter portion or an enlarged portion expanded laterally. On the other hand, the receiving member may be composed of an outer sleeve having a bottom in the center and an inner sleeve threadedly engaged radially with the inside of the outer sleeve. It is preferable to fix the enlarged portion of the elastic member between the bottom of the outer sleeve and the lower end of the inner sleeve.

In addition to the case where only the elastic spikes are arranged in necessary places, it is possible to arrange the elastic spikes in combination with rubber spikes whose protrusions are made of rubber as a whole. In this case, it is preferable to arrange the spikes so that the tip end of the elastic spikes is higher than that of the rubber spikes, and it is further preferable to provide the spikes so that, in numerical terms, the tip end of the elastic pins is higher than that of the rubber pins by 1 to 3 mm. Also, the rubber spikes may be formed as protrusions on the sole. The number of the arranged rubber spikes may preferably be 1 to 10 times larger than that of the elastic spikes.

In the case where only the elastic spikes are simply arranged on the sole, elastic members having different hardness are used. It is preferable to arrange the elastic spikes using the elastic members having a relatively high hardness to a region where a low pressure is applied to the sole during walking, and to arrange the elastic spikes using the elastic members having a relative low hardness to a region where a relatively high pressure is applied. In this case, for the elastic members having a relatively low hardness, a JIS A hardness is 40 to 80° (Shore A hardness of 41.5 to 84.5°), and for the elastic members having a relatively high hardness, a JIS A hardness is 60° or more (Shore A hardness 63° or more).

DESCRIPTION OF THE PREFERRED EMBODIMENTS

Figure 1:
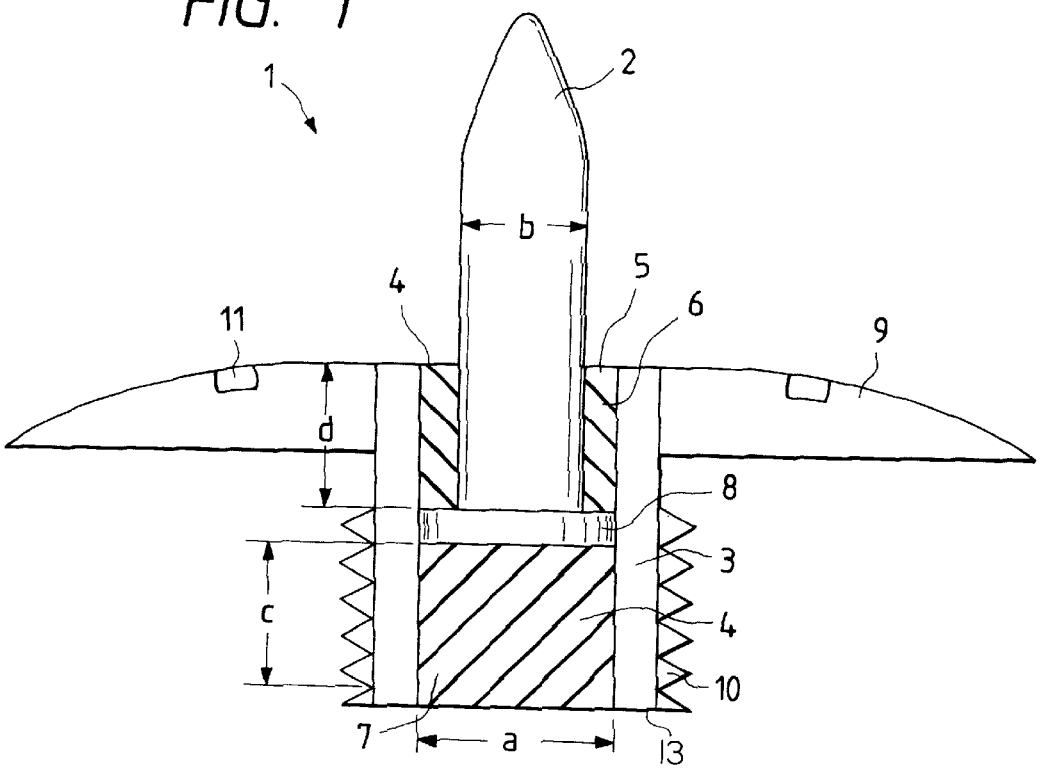
FIG. 1 is a cross-sectional view showing an elastic spike according to a first embodiment of a first aspect of the invention.

FIG. 1 is a cross-sectional view showing an elastic spike according to a first embodiment of the invention. In FIG. 1, the elastic spike 1 includes a bullet-shaped, metal pin 2 and a flange 8. The latter is received in a cylindrical receiving portion 3 made of metal, in the same manner as a rear end portion of the pin 2. The enlarged flange 8 is formed at the rear end position of the pin 2 to thereby form an inverted T-shape in side elevation. A diameter (b) of the pin 2 is 3 mm, and a diameter (a) of the flange 8 is 4.5 mm which is larger than that of the pin 2 by 1.5 mm.

In this embodiment, for an elastic member 5, a surrounding elastic member 6 is filled in a hollow space 4 in an upper portion of the flange 8 at the rear end portion of the pin 2, a rear elastic member 7 is filled in a hollow space 4 at a lower portion in FIG. 1. Both are fixed to or integrated with the receiving portion 3 and the pin 2.

In this embodiment, the surrounding elastic member 6 is made of a rubber having JIS A hardness 60° (Shore A hardness 63°) and the rear elastic member 7 is made of a rubber having JIS A hardness 80° (Shore A hardness 84.5°). The diameter of the rear elastic member 7 is 8 mm and a height (c) thereof is 4 mm and a height (d) of the surrounding elastic member 6 is 4 mm.

A screw thread 10 is formed around the receiving portion 3. Also, a skirt 9 having holes 11 is integrally formed with an opening portion of the receiving portion 3. Then, a suitable mounting means (not shown) is inserted into the holes 11 of the skirt 9 against a seat (not shown) embedded in the sole of the shoe in a threaded manner (screw-fastening).

In the elastic spike fixed to the sole, if a pressure is applied to the pin 2 upon walking, the surrounding elastic member 6 is deformed by shearing, and the rear elastic member 7 is deformed by compression relative to the seat. As a result, the pin 2 is shifted in the axial direction relative to the receiving portion 3. When the pressure is released, the pin 2 is returned back to the original position.

Figure 2:
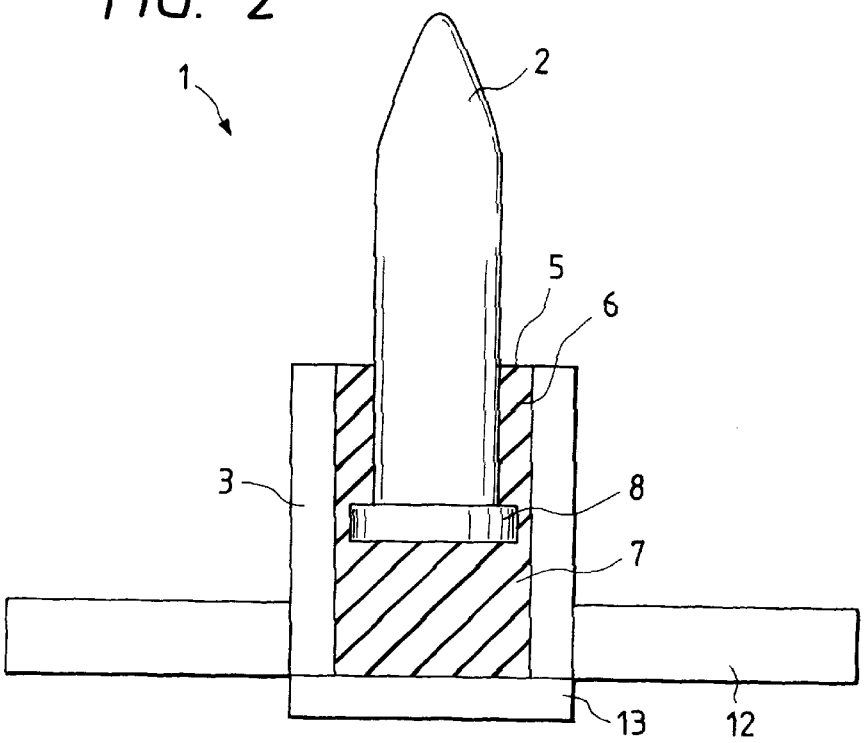
FIG. 2 is a cross-sectional view showing an elastic spike in accordance with a second embodiment of the first aspect of the invention.

FIG. 2 is a cross-sectional view showing an elastic spike in accordance with a second embodiment of the first aspect of the invention. The feature of this embodiment is that the surrounding elastic member 6 and the rear elastic member 7 are made of the same and single kind of material, whereas a disc-like support member 12 is integrally formed with a bottom 13 in the receiving portion 3. The spike is directly embedded in the shoe sole.

Figure 3:
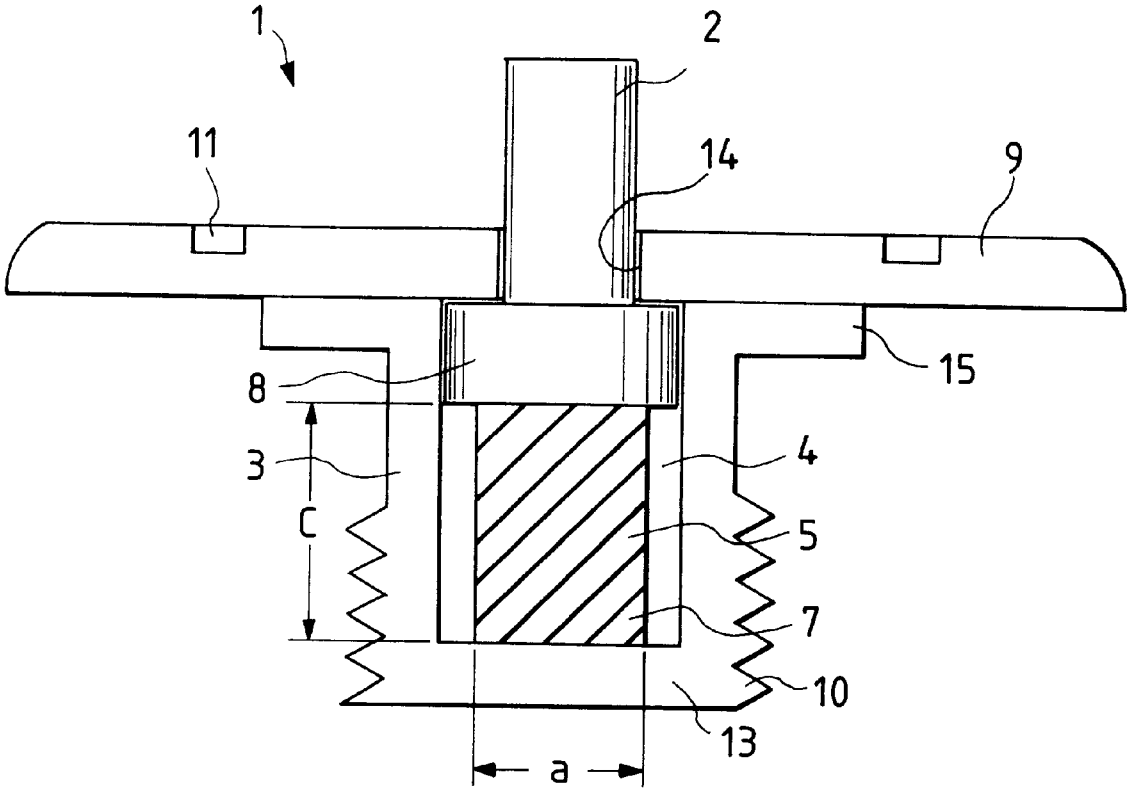
FIG. 3 is a cross-sectional view showing an elastic spike in accordance with a third embodiment of the first aspect of the invention.
Figure 4:
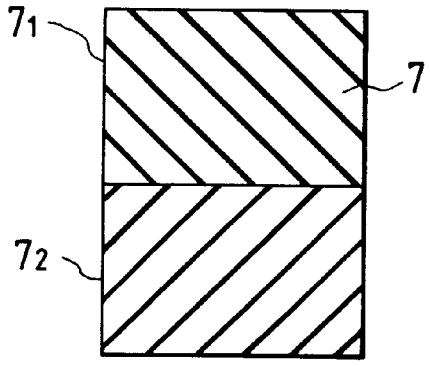
FIG. 4 is a cross-sectional view showing another embodiment of the elastic body.

FIG. 3 is a cross-sectional view showing an elastic spike in accordance with a third embodiment of the first aspect of the invention. FIG. 4 is a cross-sectional view showing another embodiment of the elastic body. The feature of this embodiment, the rear elastic member 7 is independently formed in a cylindrical shape as a discrete member from the pin 2 (in the form of an inverted T-shape having the flange 8) and the receiving portion 3 as the elastic member 5, whereas a screw 10 is formed around the receiving portion 3. A bottom 13 is formed in the deep portion of the receiving portion 3. A flange 15 extending radially outwardly is formed in the opening portion of the receiving portion 3. A hole 14 through which the body of the pin passes is formed in the skirt 9. In this embodiment, after the elastic member 5 and the pin 2 are set in the hollow portion 4 of the receiving portion 3 as shown in the drawing, the flange 15 and the skirt 9 are fastened in one piece.

The elastic member or rear elastic member 7 is formed by combining rubbers 71 and 72 which have different hardnesses as shown in FIG. 4. In the example shown in FIG. 4, the upper portion 71 is made of JIS A hardness of 60° (Shore A hardness 63°), and the lower portion 72 is made of JIS A hardness of 80° (Shore A hardness 84.5°). A diameter (a) of the elastic member is 3 mm and a height (c) thereof is 4 mm.

Figure 5:
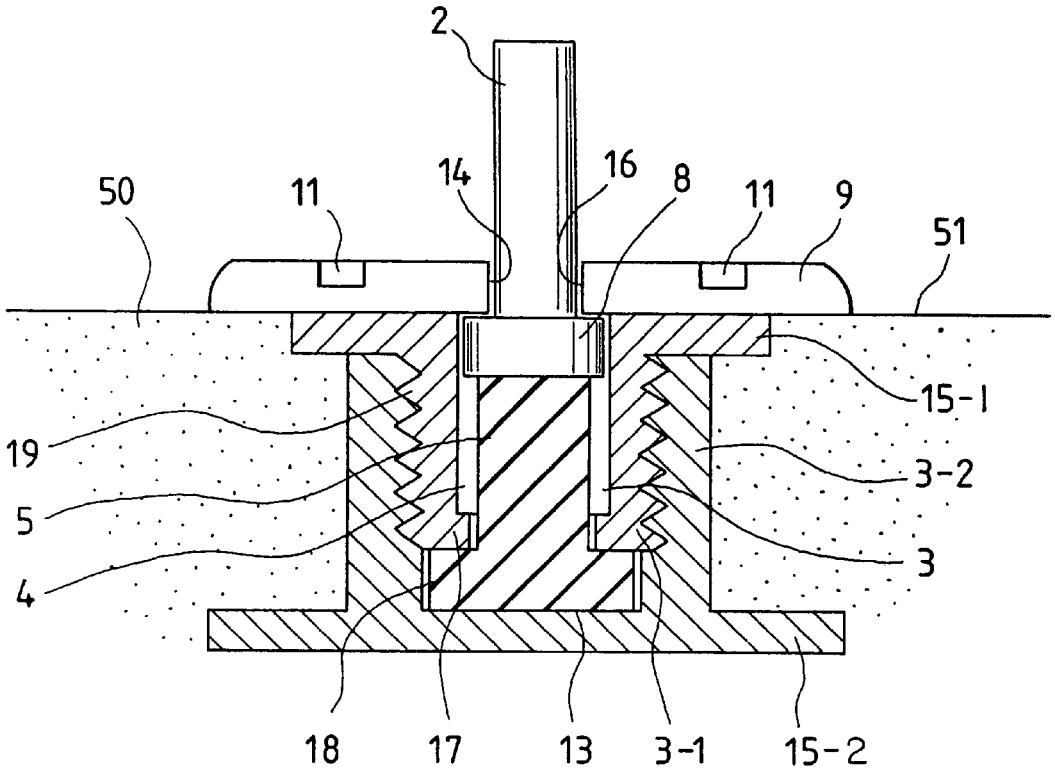
FIG. 5 is a cross-sectional view showing an elastic spike in accordance with a fourth embodiment of the first aspect of the invention.
Figure 6:
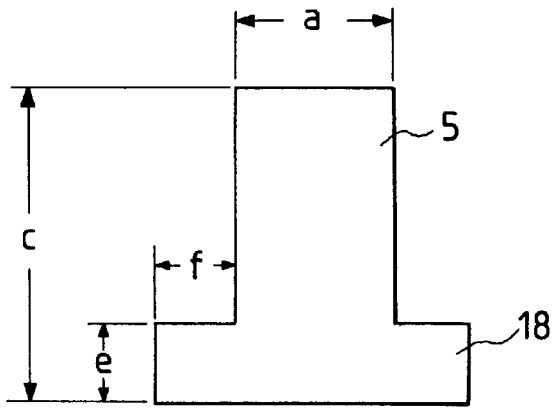
FIG. 6 is a schematic view showing the elastic member.

FIG. 5 is a cross-sectional view showing an elastic spike in accordance with a fourth embodiment of the first aspect of the invention. The feature of this embodiment is that the receiving portion 3 is provided with an inner sleeve 3-1 having flange 15-1 above it and an outer sleeve 3-2 having a flange 15-2 normally embedded in a shoe sole 50 for performing a seat function. A rear end portion of the inner sleeve 3-1 has a reduced diameter portion 17 (which is a smaller diameter); and the elastic member 5 has an enlarged portion 18 which is expanded radially at the lower end portion. The inner sleeve 3-1 and the outer sleeve 3-2 are detachably coupled with each other by a screw 19. When the elastic member 5 is to be set, the enlarged portion 18 of the elastic member is compressed and clamped between the bottom 13 of the outer sleeve and the reduced diameter portion 17 of the inner sleeve. Incidentally, the flange 15-1 located above the inner sleeve 3-1 is formed integrally with the skirt 9. As shown in FIG. 5, when the elastic spike is fixed to the shoe sole, the lower surface of the skirt is brought into contact with the sole surface 51. Incidentally, in this embodiment, the diameter (a) of the elastic member 5 is 3 mm, a width (f) of the enlarged portion is 1 mm and height (e) is 2 mm and a height (c) thereof is 7 mm.

Figure 7:
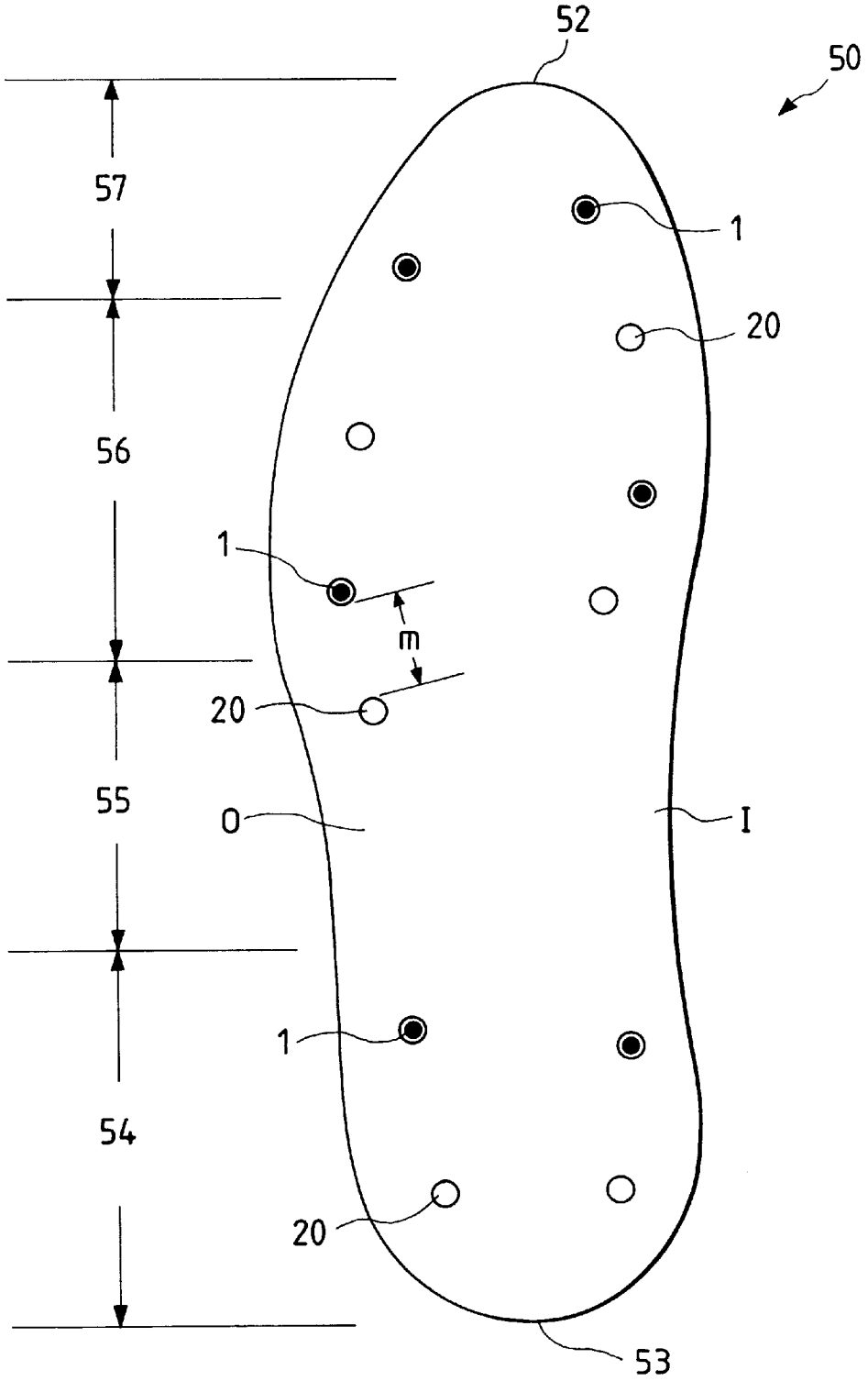
FIG. 7 is a plan view showing a sole according to a first embodiment of a second aspect of the invention.

FIG. 7 is a plan view showing a sole according to a first embodiment of a second aspect of the invention. In FIG. 7, assuming that the sole 50 is divided into a heel portion 54, an arch portion 55 of the foot, a tread portion 56 and toe portion 57, two elastic spikes (which are of the type shown in FIG. 3) are provided on a forward side in the heel portion 54, and two rubber spikes 20 which was protruded from the rubber sole are provided on a rear side in the heel portion 54. These spikes are arranged to be grouped on the inside I and outside O of the sole. In the arch portion 55 of foot, the single rubber spike 20 is arranged at a position close to the front side on the outside O. In the tread portion 56, two rubber spikes 20 are arranged on the inside I around the elastic spike 1, one rubber spike 20 being located on the forward side and the other rubber spike 20 being located on the rear side. On the outside, one rubber spike 20 is provided on the forward side, and the elastic spike 1 is provided on the rear side. In the toe portion 57, the elastic spikes 1 are arranged on the inside I and the outside O, respectively, one by one. Incidentally, the rubber spikes 20 are thicker than the elastic spikes 1.

The feature of this embodiment is that, throughout the sole 50, the same number of the elastic spikes 1 and the rubber spikes 20 are alternatively arranged on the inside I and the outside O. However, a relatively large number of spikes are arranged on the tread portion 56 to which a high pressure is applied upon walking or playing, and a relatively small number of spikes are arranged on the arch portion of the foot to which a low pressure is applied.

It is preferable to use four to twelve elastic spikes 1. For example, when four elastic spikes 1 are used, the spikes are arranged on the tread portion 56 and the toe portion 57 as shown in FIG. 7 and the elastic spikes 1 in the heel 54 may be replaced by the rubber spike 20.

The ratio of use of the rubber spikes 20 to the elastic spikes is one in this embodiment, namely, the numbers of the rubber spikes and the elastic spikes are the same. However, it is preferable to set the ratio in the range of one to ten. Also, an interval (minimum distance) m between the spikes (regardless of the kinds of the spikes) is preferably set in the range of 5 to 20 mm.

Figure 8:
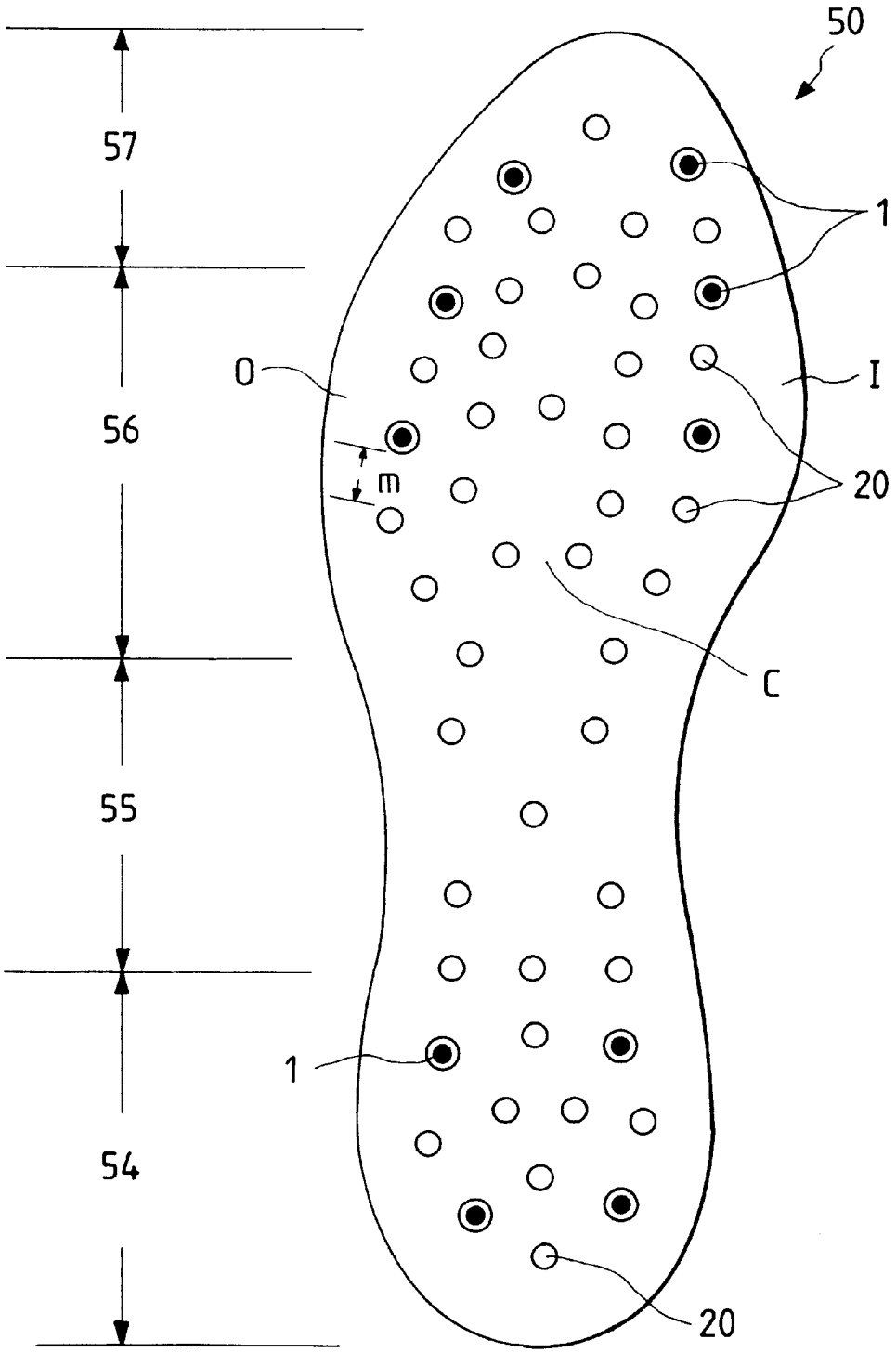
FIG. 8 is a plan view showing a sole in accordance with a second embodiment of the second aspect of the invention.

FIG. 8 is a plan view showing a sole in accordance with a second embodiment of the second aspect of the invention. The feature of this embodiment is that four elastic spikes 1 are provided on the heel portion 54, two by two on the inside I and the outside O. The elastic spikes 1 are arranged in the tread portion 56 in the same way. Two elastic spikes 1 are provided on the toe portion 57, one by one on the inside I and the outside O. The rubber spikes 20 are arranged so that the distance (m) may be kept substantially constant over the sole including the arch of the foot. In this embodiment, the rubber spikes 20 are also provided between the inside I and the outside O, i.e., the central portion C. In this embodiment, the total number of the elastic spikes 1 are ten and the total number of the rubber spikes 20 is four times larger than the elastic spikes 1, i.e., 40.

Figure 9:
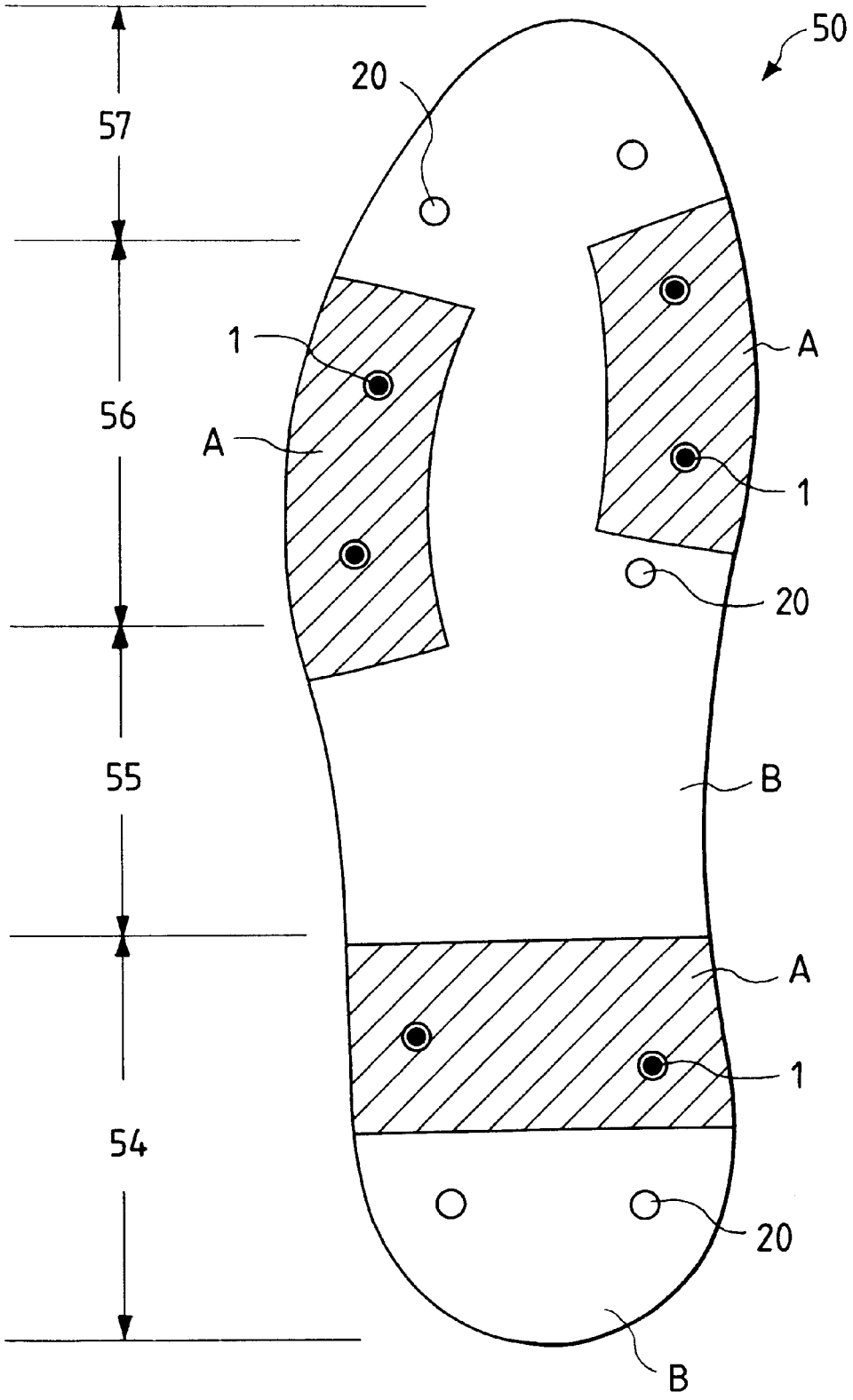
FIG. 9 is a plan view showing a sole in accordance with a third embodiment of the second aspect of the invention.

FIG. 9 is a plan view showing a sole in accordance with a third embodiment of the second aspect of the invention. The feature of this embodiment, the material in regions A for the sole 50 provided with the elastic spikes is a rubber that is harder than that in regions B which are the rest with the rubber spikes 20. The material used in regions A for the sole is preferably various kinds of rubbers having JIS A hardness of 60 to 90° (Shore A hardness 63 to 95°) such as urethane rubber, plastic and other fur material. On the other hand, for regions B, various rubbers or urethane rubbers which are softer than the material for regions A in the JIS A hardness range of 50 to 70° (Shore A hardness 52 to 73.5°. It is preferable to form the rubber spikes 20 with such material protruded from the sole. Incidentally, in this embodiment, the elastic spikes 1 are arranged primarily for the tread portion 56 and secondary for the heel portion 54. Only the spikes 20 are arranged for the arch 55 portion of the foot and the toe portion 57.

Figure 10:
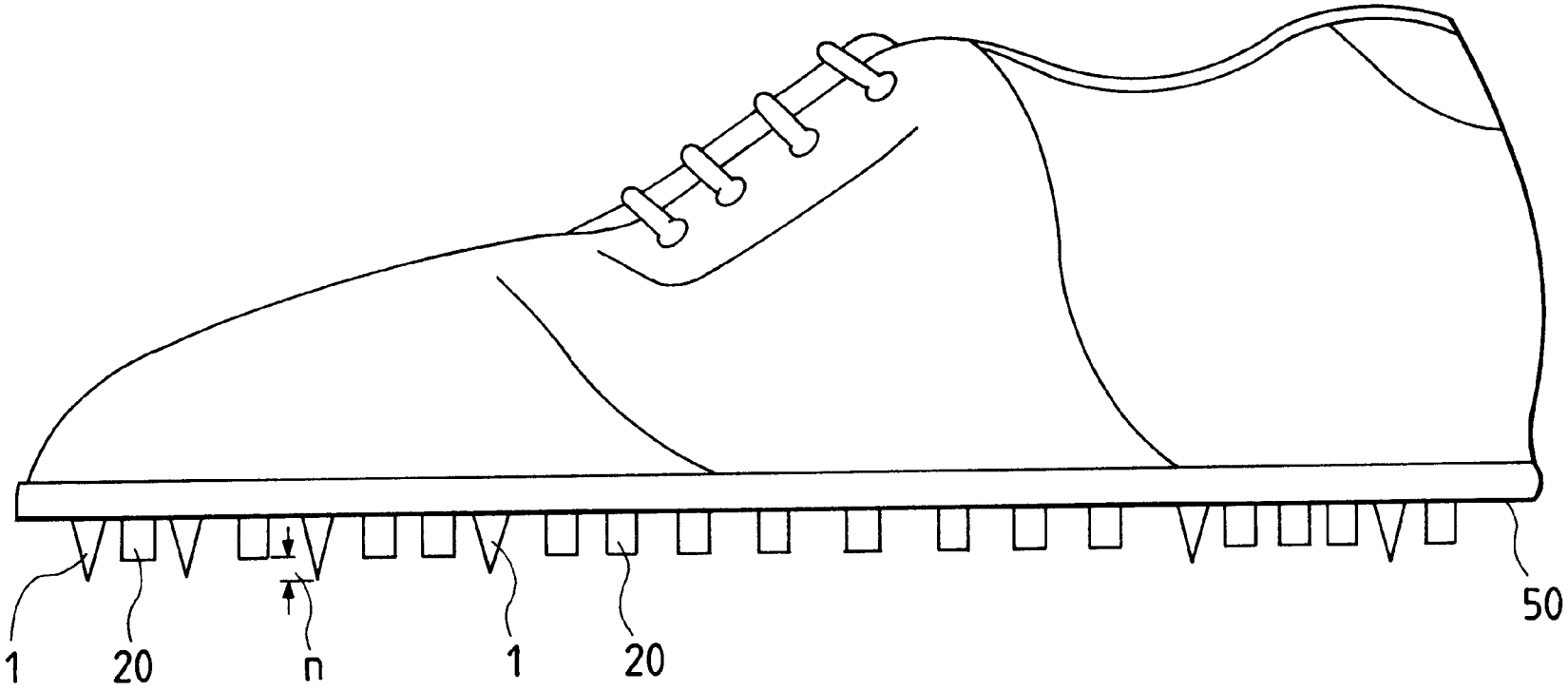
FIG. 10 is a side elevational view showing a golf shoe. This embodiment shows an example in which a height of the pins 2 of the spikes 1 is greater than that of the rubber spikes 20 by value n.

FIG. 10 is a side elevational view showing a golf shoe. This embodiment shows an example in which a height of the pins 2 of the spikes 1 is greater than that of the rubber spikes 20 by value n. The difference n in height therebetween is preferably set in the range of 1 to 3 mm.

Figure 11:
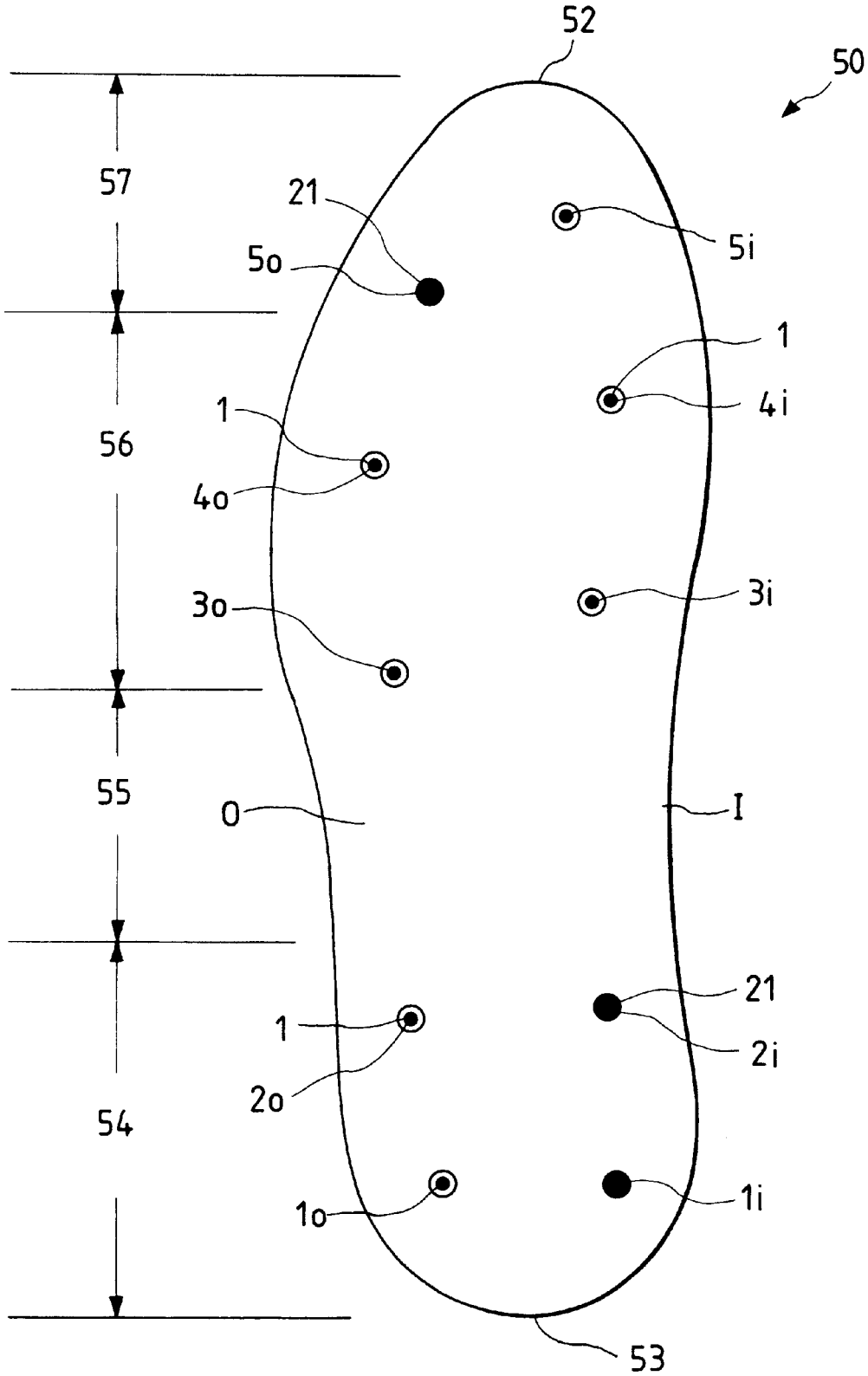
FIG. 11 is a plan view showing a sole in accordance with one of the embodiments of a third aspect of the invention.

FIG. 11 is a plan view showing a sole in accordance with a first embodiment of a third aspect of the invention. As shown in FIG. 11, two spikes are provided on the heel on the inside I, two spikes are arranged on the tread portion 56 on the inside I, and a spike is arranged on the toe portion 57 on the inside. Also, two spikes are arranged on the tread portion 54 on the outside O, the two spikes are arranged on the tread portion 56 on the outside O and a single spike is arranged on the toe 57 on the outside O. These spikes are arranged at the interval in the longitudinal direction of the sole, respectively. However, the positions of the spikes are somewhat displaced in the upward direction on the right side with respect to the respective three spikes on the tread portion 56 and the toe portion 57 on the inside and on the outside. In this case, when the player walks on a hard paved road, the pressure caused by the shift of weight to the sole is applied from the rear end 53, and gradually shifted toward the forward side 52. However, the pressure is not uniform in the widthwise direction on the inside I and the outside O. Namely, upon walking, the pressure is applied in the order of 1*o*, 2*o*, 3*o*, 4*o*, 4*i* and 5*i* or 1*o*, 2*o*, 3*o*, 4*o*, 3*i*, 4*i* and 5*i*. The pressure applied to the position of 5*o* of the toe portion 57 and the 1*i* and 2*i* of the heel portion 54 is relatively low.

According to the invention, at least one elastic spike 1 is provided at a position where a high pressure is applied, and hard elastic spikes 21 made of elastic material whose hardness is relatively high and whose deformation caused by the pressure is smaller than that of the elastic spike 1 is provided at a position where a low pressure is applied. Namely, JIS A hardness of the elastic material 5 used for the elastic spikes 1 is in the range of 40 to 80° (Shore A hardness 41.5 to 84.5°), whereas JIS A hardness of the elastic material 5 used for the hard elastic member 21 is equal to or greater than 60° (Shore A hardness 63° or more). In addition, the elastic material for the hard elastic spikes is made harder within the above-described range.

With respect to a height from the sole 50 to the tip of the pin, the elastic spikes 1 may be the same as the hard elastic spikes 21 or the height of the pins 2 of the elastic spikes 1 may be somewhat greater than the height of the pins 2 of the hard elastic spikes 21. For example, the height of the pins of the elastic spikes 1 may be higher within, for example, 3 mm. With such an arrangement, upon walking on the hard road, the player is not tired because the pushup by the pins may be suppressed. On the other hand, in case of walking on a soft ground such as lawn, in the same way as in golf shoes where the spikes are conventionally arranged, the pins may readily stick into the ground. Accordingly, there is no problem in ground gripping effects at all. Incidentally, if the rubber spikes are needed in the sole region between the inside I and the outside O, the region between the elastic spikes or the region between the hard elastic spikes, it is possible to suitably provide the spikes.

With the elastic spikes according to the first aspect of the invention, since pins are slid rearwardly upon walking on the hard paved road when the spikes are used in golf shoes, the collision noises of the pins and the collision shock to the feet may be suppressed. In particular, by using cylindrical rubbers having JIS A hardness of 40 to 90° (Shore A hardness 41.5 to 95.0°) and a hysteresis loss of 10 to 50% for the elastic material for the elastic spikes, it is possible to remarkably improve the fatigue aspect upon walking.

Also, more effectively, the sports shoes according to the second aspect of the invention have an excellent slippage preventing feature of the elastic spikes on the slant surface and simultaneously facilitate the walking with the spikes.

Furthermore, in sports shoes according to the third aspect of the invention, in particular in case of golf shoes, elastic spikes using elastic members made of relatively soft material are used in the portion where a relatively high pressure is applied in the sole, and a hard elastic spikes using elastic members made of relatively hard material are used in the portion where a relatively low pressure is applied in the sole. Accordingly, it is possible to more effectively attain the objects of the present invention.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What we claim is:

1. A spike for a sports shoe, comprising: a pin having an enlarged flange formed at a rear end portion thereof; and elastic member made of rubber, a cylindrical receiving portion forming a hollow space therein; and a skirt having a center hole and fastened at an opening portion of the hollow space of the receiving portion, said pin passing in the center hole and, in said hollow space of the receiving portion said enlarged flange of the pin and the elastic member are positioned; wherein said elastic member has a JIS A hardness of 40 to 90° and a column-like shape of solid rubber having a diameter in the range of 2–8 mm and a height in the range of 3–8 mm, said receiving portion has a bottom surface at the deepest portion thereof and said receiving portion is threaded around an outer surface thereof, and said elastic member is disposed between said enlarged flange of the pin and said bottom of the receiving portion so as to fill said hollow space of the receiving portion; whereby said spike is detachably mounted to a seat which is embedded in the sole of a sports shoe.

2. The spike according to claim 1, wherein the elastic member has a hysteresis loss of 10 to 50%.

3. The spike according to claim 1, wherein the elastic member is formed by combining rubbers of different hardnesses.

4. The sports shoe according to claim 1, wherein a tip end of said pin of said elastic spike is higher than a tip end of the rubber spike from the sole.

5. The sports shoe according to claim 1, wherein the tip end of said pin of said elastic spike is higher than the tip end of said rubber spike by 1 to 3 mm.

6. The sports shoe according to claim 1, wherein the number of the rubber spikes is one to ten times greater than that of the elastic spikes.

7. A sports shoe having a combination of elastic spikes and rubber spikes; wherein the elastic spikes are composed of a pin having an enlarged flange formed at a rear end portion thereof; an elastic member made of rubber, a cylindrical receiving portion forming a hollow space therein, and a skirt having a center hole and fastened at an opening portion of the hollow space of the receiving portion, a said pin passing in the center hole and, in said hollow space of the receiving portion said enlarged flange of the pin and the elastic member are positioned; wherein said elastic member has a JIS A hardness of 40 to 90° and a column-like shape of solid rubber having a diameter in the range of 2–8 mm and a height in the range of 3–8 mm, said receiving portion has a bottom surface at the deepest portion thereof and said receiving portion is threaded around an outer surface thereof, and said elastic member is disposed between said enlarged flange of the pin and said bottom of the receiving portion so as to fill said hollow space of the receiving portion; and wherein said rubber spikes are composed of a protrusion of the sole, whereby said elastic spikes are detachably mounted to a seat which is embedded in the sole of a sports shoe.

8. A sports shoe comprising: a combination of first elastic spikes having a relatively soft elastic member and second elastic spikes having a relatively hard elastic member; wherein the first and second elastic spikes are composed of a pin having an enlarged flange formed at a rear end portion thereof, elastic members made of rubber, a cylindrical receiving portion forming a hollow space therein, and a skirt having a center hole and fastened at an opening portion of the hollow space of the receiving portion, said pin passing in the center hole and, in said hollow space of the receiving portion said enlarged flange of the pin and the elastic member are positioned; wherein said elastic member of said first elastic spikes has a JIS A hardness of 40 to 80° and said elastic member of said second elastic spikes has a JIS A hardness of 60° or more and is harder than the elastic member of the first elastic spikes; wherein said elastic members of the first and second elastic spikes have a column-like shape of solid rubber having a diameter in the range of 2–8 mm and a height in range of 3–8 mm, said receiving portion has a bottom surface at the deepest portion thereof and said elastic members of the first and second elastic spikes are disposed between said enlarged flange of the pin and said bottom of the receiving portion so as to fill said hollow space of the receiving portion and wherein said first elastic spikes having the relatively soft elastic member are mounted at a portion in which a relatively high pressure to a sole of the shoe is applied and said second elastic spikes having the relatively hard elastic member are mounted at a portion in which a relatively low pressure to the sole of the shoe is applied.

9. The sports shoe of claim 8, wherein said first elastic spikes are placed on the sole of said sports shoes around the periphery in areas of low pressure and said second elastic spikes are spaced on said heel area and a tip area of said sole along a periphery thereof low pressure.

10. The sports shoe of claim 8, wherein a height of said first elastic spikes measured from the sole is at least as high as a height of said second elastic spikes.

11. The sports shoe of claim 8, wherein a height of said first elastic spikes measured from the sole is greater than a height of said second elastic spikes.

* * * * *